US006382409B1

(12) United States Patent
Scala

(10) Patent No.: US 6,382,409 B1
(45) Date of Patent: May 7, 2002

(54) CONTACT LENS CASE WITH TIME TRACKING STRUCTURE

(76) Inventor: Ann Scala, 3 Melissa Dr., Farmingville, NY (US) 11738

( * ) Notice: Subject to any disclaimer, the term of this patent is extended or adjusted under 35 U.S.C. 154(b) by 0 days.

(21) Appl. No.: 09/615,337

(22) Filed: Jul. 12, 2000

(51) Int. Cl.[7] ..... A45C 11/04

(52) U.S. Cl. ..... 206/5.1; 116/307; 116/308; 116/316; 116/318; 206/459.1

(58) Field of Search ..... 206/5.1, 459.1; 116/308, 309, 316, 318, 321, 307; 134/901

(56) References Cited

U.S. PATENT DOCUMENTS

| | | | | | |
|---|---|---|---|---|---|
| 4,807,750 | A | * | 2/1989 | Ryder et al. | 206/5.1 |
| 4,909,382 | A | * | 3/1990 | Cuppari | 206/5.1 |
| 5,280,834 | A | * | 1/1994 | Berkley | 206/5.1 |
| 5,328,597 | A | * | 7/1994 | Boldt, Jr. et al. | 206/5.1 |
| 5,452,792 | A | * | 9/1995 | Zautke et al. | 206/5.1 |
| 5,699,900 | A | * | 12/1997 | Artis | 206/5.1 |
| 6,038,997 | A | * | 3/2000 | Madden | 116/308 |

* cited by examiner

*Primary Examiner*—Bryon P. Gehman
(74) *Attorney, Agent, or Firm*—Michael I. Kroll

(57) ABSTRACT

A contact lens case for tracking as time of use for both a left and right contact lens. The case includes a base having a top side; a left side cup and right side cup positioned on the top side of the base each receiving a respective one of the left and right contact lenses; a left side timing mechanism for indicating a month and date related to use of the left contact lens; and a right side timing mechanism for indicating a month and date related to use of the right contact lens. The left and right side timing mechanisms may each include a digital display indicating a month and date related to use of the left and right contact lenses, respectively. Alternatively, the left and right timing mechanisms may each include a month and date wheel rotatably secured to the base for providing a month and date related to a respective contact lens. The rotatable month and date wheels of the left and right timing mechanisms each include a locking mechanism for preventing unwanted rotation of the wheels. The left and right side cups each include a side wall extending from the base to form a pool and a cover for selectively restricting access to the pool formed by the side wall. The cover of the left and right side cups each include indicia indicating which contact lens is retained by the cup.

8 Claims, 10 Drawing Sheets

CONTACT LENS CASE WITH TIME TRACKING STRUCTURE

BACKGROUND OF THE INVENTION

1. Field of the Invention

The present invention relates generally to cases and, more specifically, to a case for retaining contact lenses with an ample amount of solution for preventing the lenses from drying out and tracking the amount of time between replacement of the lenses.

2. Description of the Prior Art

Numerous types of contact lens cases have been provided in the prior art. For example, U.S. Pat. No. 4,807,750; 4,909,382; 5,328,597; 5,452,792 and 5,699,900 all are illustrative of such prior art. While these units may be suitable for the particular purpose to which they address, they would not be as suitable for the purposes of the present invention as heretofore described.

U.S. Pat. No. 4,807,750

Inventor: Francis E. Ryder et al.

Issued: Feb. 28, 1989

A lens storage container in combination with a lens support structure in which a pair of lens hold members carrying a lens cover for each lens is independently pivotal upon a support frame, and a latch structure is provided for each of the holder members. The location of the latch structure above the lens enclosure prevents gravity action from pulling the lens downwardly into the path of the latch structure and this prevents any lens damage therefrom.

U.S. Pat. No. 4,909,382

Inventor: Pasquale J. Cuppari

Issued: Mar. 20, 1990

A contact lens carrying case contains two separate sections each having a pair of lens compartments with screw-on tops, for independently disinfecting and rinsing a pair of contact lenses. The case contains a closeable lid with a mirror located therein, and a timer with an alarm for timing the disinfecting and rinsing cycles. Each separate section is removable for cleaning. The case is usable for any contact lens, but is adapted for an AODISC® catalyst used in SEPTICON® and AOSEPT® systems for soft contact lenses.

U.S. Pat. No. 5,328,597

Inventor: Norton K. Boldt, Jr.

Issued: Jul. 12, 1994

A self-contained electronic monitoring unit for attachment to a device, such as a water filter, designed to be used until the occurrence of a predetermined event such as a predetermined number of uses, includes transducer for providing distinct outputs such as different audio output signals. A programmed integrated circuit and use detecting means such as electrical contacts detect each use of the device and monitor when the device is operational, when the end of life event is imminent and has occurred. The integrated circuit is programmed to operate the transducer to produce output signals during each use of the device informing the user that the device is operational, that the predetermined event or end of useful life is imminent and that the useful life has expired. The unit includes a battery for supplying power to the transducer and integrated circuit.

U.S. Pat. No. 5,452,792

Inventor: Stephen Zautke et al

Issued: Sep. 26, 1995

A contact lens case including a pair of container caps with timing mechanism for indicating when to perform a certain activity. These timing-keeping container caps comprising a cover and flange, one of which is rotatable to reference calendar days, month names or other time-related indicia.

U.S. Pat. No. 5,699,900

Inventor: Derrick L. Artis

Issued: Dec. 23, 1997

A contact lens storage device and method is provided. The contact lens storage device includes a housing, a cover for the housing and a counter. The cover is cooperatively arranged with and attached to the housing such that the counter automatically operates to display number of days that the contact lenses have been worn by the contact lens wearer. Thus, the contact lens wearer is likely to refrain from using contact lenses beyond the useful life of the lenses.

SUMMARY OF THE PRESENT INVENTION

The present invention relates generally to cases and, more specifically, to a case for retaining contact lenses with an ample amount of solution for preventing the lenses from drying out and tracking the amount of time between replacement of the lenses.

A primary object of the present invention is to provide a contact lens case that will overcome the shortcomings of prior art devices.

Another object of the present invention is to provide a contact lens case which is able to store contact lenses and measure the time of use for each lens.

A further object of the present invention is to provide a contact lens case which is able to provide an indication of the length each individual lens has been used by a person to determine whether the lens needs to be replaced.

A yet further object of the present invention is to provide a contact lens case including a manual clock for indicating a month and day at which the person began use of an individual contact lens.

A still further object of the present invention is to provide a contact lens case wherein the manual clock provides a digital LED readout.

A further object of the present invention is to provide a contact lens case wherein the manual clock includes a plurality of wheels including indicia and the case includes a recess extending therethrough whereby when each wheel is turned by a user, a particular month or day indicated by the indicia on the wheel is viewable through a respective recess.

Another object of the present invention is to provide a contact lens case that is simple and easy to use.

A still further object of the present invention is to provide a contact lens case that is economical in cost to manufacture.

Additional objects of the present invention will appear as the description proceeds.

A contact lens case for tracking as time of use for both a left and right contact lens is disclosed by the present invention. The case includes a base having a top side; a left side cup and right side cup positioned on the top side of the base each receiving a respective one of the left and right contact lenses; a left side timing mechanism for indicating a month and date related to use of the left contact lens; and a right side timing mechanism for indicating a month and date related to use of the right contact lens. The left and right side timing mechanisms may each include a digital display indicating a month and date related to use of the left and right contact lenses, respectively. Alternatively, the left and right timing mechanisms may each include a month and date wheel rotatably secured to the base for providing a month and date related to a respective contact lens. The rotatable month and date wheels of the left and right timing mechanisms each include a locking mechanism for preventing unwanted rotation of the wheels. The left and right side cups each include a side wall extending from said base to form a pool and a cover for selectively restricting access to said pool formed by said side wall. The cover of the left and right side cups each include indicia indicating which contact lens is retained by the cup.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
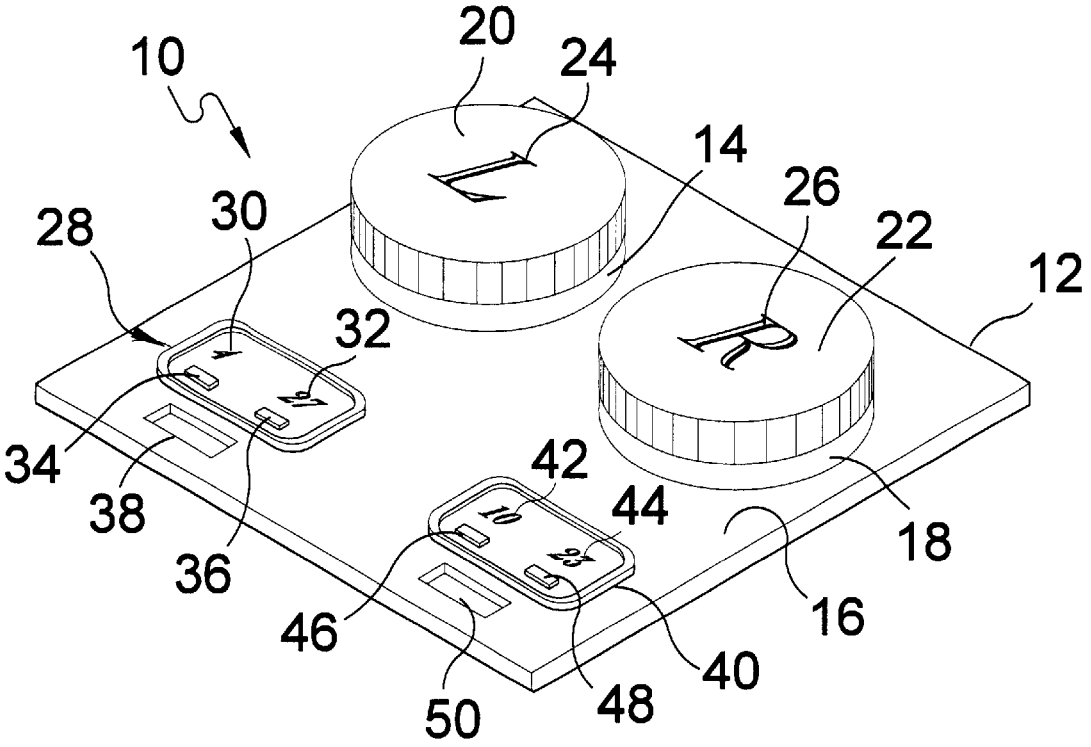
FIG. 1 is a top perspective view of the contact lens case of the present invention including a digital calendar.

Turning now descriptively to the drawings, in which similar reference characters denote similar elements throughout the several views, the Figures illustrate the contact lens case of the present invention. With regard to the reference numerals used, the following numbering is used throughout the various drawing figures.

10 contact lens case of the present invention
12 base
14 left side cup
16 top side of the base
18 right side cup
20 cover for left side cup
22 cover for right side cup
24 indicia indicating the cover is for covering the left side cup
26 indicia indicating the cover is for covering the right side cup
28 left side timer
30 left side month LED
32 left side date LED
34 left side month control button
36 left side date control button
38 left side activation button
40 right side timer
42 right side month LED
44 right side date LED
46 right side month control button
48 right side date control button
50 right side activation button
52 timer mechanism
54 left side month recess
56 left side date recess
58 left side month wheel
60 indicia indicative of the months of the year
62 left side date wheel
64 indicia indicative of dates of the month
66 right side month recess
68 right side date recess
70 right side month wheel
72 indicia indicative of one month
74 right side date wheel
76 indicia indicative of the dates of the year
77 locking mechanism
78 side wall
80 outer side of side wall
82 thread on outer side of side wall
84 base of cover
86 skirt extending from base of cover
88 arrow indicating direction to turn cover to remove from atop cup
90 contact lens
92 bottom side of base
94 pin for connecting wheels to bottom side of base
96 pin hole for receiving pin
98 recess in base
100 housing
102 plate

104 recess in plate

106 screw

108 recess in housing for receiving screw

DETAILED DESCRIPTION OF THE PREFERRED EMBODIMENT

Turning now descriptively to the drawings, in which similar reference characters denote similar elements throughout the several views, FIGS. 1 through 10 illustrate the contact lens case of the present invention indicated generally by the numeral 10.

The contact lens case 10 is shown in FIG. 1. As can be seen from this figure, the contact lens case 10 includes a base 12, a left side cup 14 extending from a top side 16 of the base 12 and a right side cup 18 also extending from the top side 16 of the base 12. The left side cup 14 is provided on one side of the top side 16 and includes a cover 20 for restricting access to the inside of the left side cup 14. The right side cup 18 is provided on a side of the top side 16 opposite the left side cup 14 and includes a cover 22 for restricting access to the inside of the right side cup 18. The cover 20 for the left side cup 14 includes indicia 24 printed thereon indicating it is for covering the left side cup 14. The cover 22 for the right side cup 18 includes indicia 26 printed thereon indicating it is for covering the right side cup 18.

Positioned adjacent the left side cup 14 is a left side timer 28. The left side timer 28 is manually operated to indicate the month and date the user first began using a contact lens for the left eye. The left side timer 28 shown in this figure is a digital display including a left side month LED 30 for indicating the month and a left side date LED 32 for indicating the date. A left side month control button 34 is provided for manually changing the left side month LED 30 and a left side date control button 36 is provided for manually changing the left side date LED 32. A left side activation button 38 is provided for activating the left side month and date control buttons 34 and 36, respectively. The left side activation button 38 is preferably recessed to prevent unintended activation thereof and thus unintentional changing of the left side month and date LED's 30 and 32, respectively. The left side month and date LED's 30 and 32, respectively, cannot be changed by the left side month and date control buttons 34 and 36 until the left side activation button 38 is pressed. Upon reactivation of the left side activation button 38, the left side month and date LED's 30 and 32, respectively, will return to a state in which they cannot be changed.

Positioned adjacent the right side cup 18 is a right side timer 40. The right side timer 40 is manually operated to indicate the month and date the user first began using a contact lens for the right eye. The right side timer 40 shown in this figure is a digital display including a right side month LED 42 for indicating the month and a right side date LED 44 for indicating the date. A right side month control button 46 is provided for manually changing the right side month LED 42 and a right side date control button 48 is provided for changing the right side date LED 44. A right side activation button 50 is provided for activating the right side month and date control buttons 46 and 48, respectively. The right side activation button 50 is preferably recessed to prevent unintended activation thereof and thus unintentional changing of the right side month and date LED's 42 and 44, respectively. The right side month and date LED's 42 and 44, respectively, cannot be changed by the right side month and date control buttons 46 and 48 until the right side activation button 50 is pressed. Upon reactivation of the right side activation button 50, the right side month and date LED's 42 and 44, respectively, will return to a state in which they cannot be changed.

Figure 2:
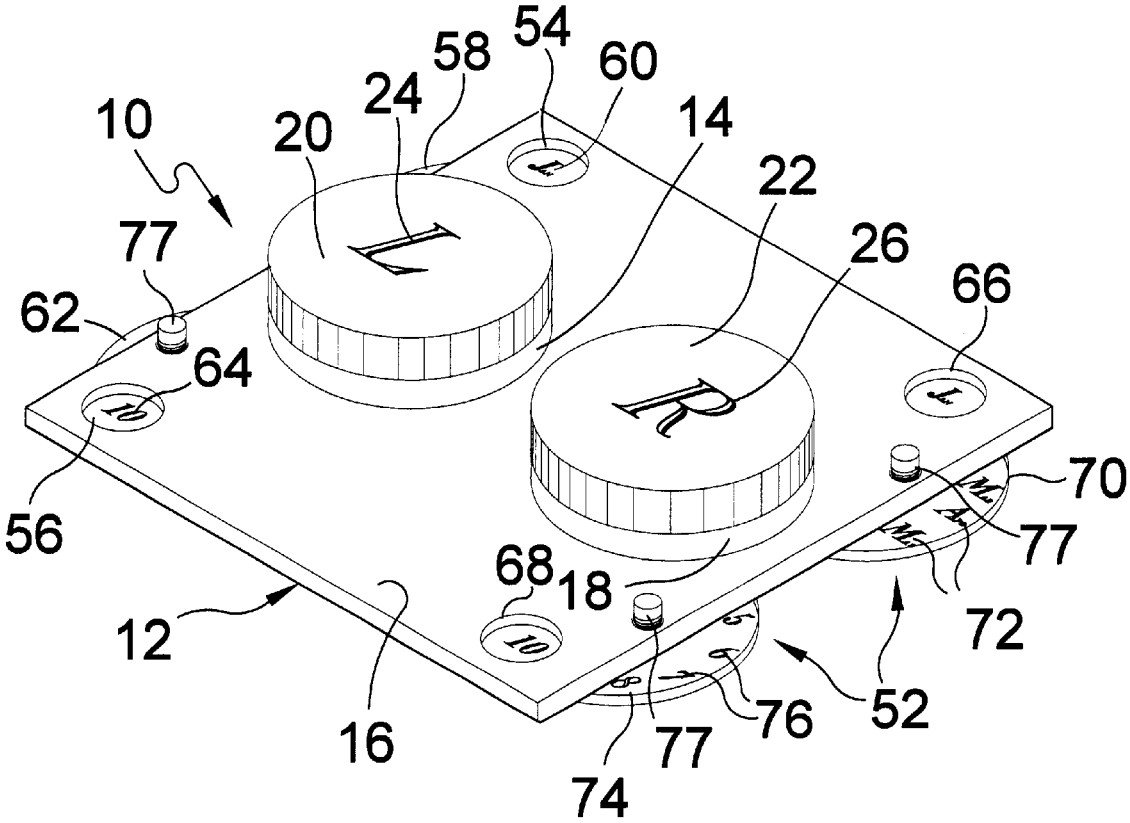
FIG. 2 is a top perspective view of the contact lens case of the present invention including a manual display.

FIG. 2 illustrates the contact lens case 10 with an alternative timer mechanism 52. As can be seen from this figure, when the timer mechanism 52 is used, the base 12 includes a left side month recess 54 and a left side date recess 56. A left side month wheel 58 is rotatably positioned on a bottom side of the base 12 and includes indicia 60 indicative of the months of the year thereon. The left side month wheel 58 is positioned such that the indicia 60 indicative of a single month is visible through the left side month recess 54 at any one time. As the left side month wheel 58 is rotated, the indicia 60 viewable through the left side month recess 54 changes. A left side date wheel 62 is rotatably positioned on a bottom side of the base 12 and includes indicia 64 indicative of the dates of the year thereon. The left side date wheel 62 is positioned such that the indicia 64 indicative of a single date is visible through the left side date recess 56 at any one time. As the left side date wheel 62 is rotated, the indicia 64 viewable through the left side date recess 56 changes. The use of two separate recesses for viewing a left side month and date are shown for purposes of illustration only. Actually, it is possible to provide a single recess for viewing both a month and date therethrough and the scope of this invention should not be limited to the embodiment shown having two recesses, one each for the left month and left date.

A right side month recess 66 and a right side date recess 68. A right side month wheel 70 is rotatably positioned on a bottom side of the base 12 and includes indicia 72 indicative of the months of the year thereon. The right side month wheel 70 is positioned such that the indicia 72 indicative of a single month is visible through the right side month recess 66 at any one time. As the right side month wheel 70 is rotated, the indicia 72 viewable through the right side month recess 66 changes. A right side date wheel 74 is rotatably positioned on a bottom side of the base 12 and includes indicia 76 indicative of the dates of the year thereon. The right side date wheel 74 is positioned such that the indicia 76 indicative of a single date is visible through the right side date recess 66 at any one time. As the right side date wheel 74 is rotated, the indicia 76 viewable through the right side date recess 66 changes. Actually, it is possible to provide a single recess for viewing both a month and date therethrough and the scope of this invention should not be limited to the embodiment shown having two recesses, one each for the right month and left date.

A locking mechanism 77 is provided for each of the left side month wheel 58, the left side date wheel 62, the right side month wheel 70 and the right side date wheel 74. The locking mechanism 77 acts to prevent unintentional rotation of the wheels. Thus, the month and date set by the user cannot be unintentionally or inadvertently changed. The locking mechanism 77 is preferably positioned within a recess in the top side 16 of the base 12 to aid in preventing unintended activation thereof.

Figure 3:
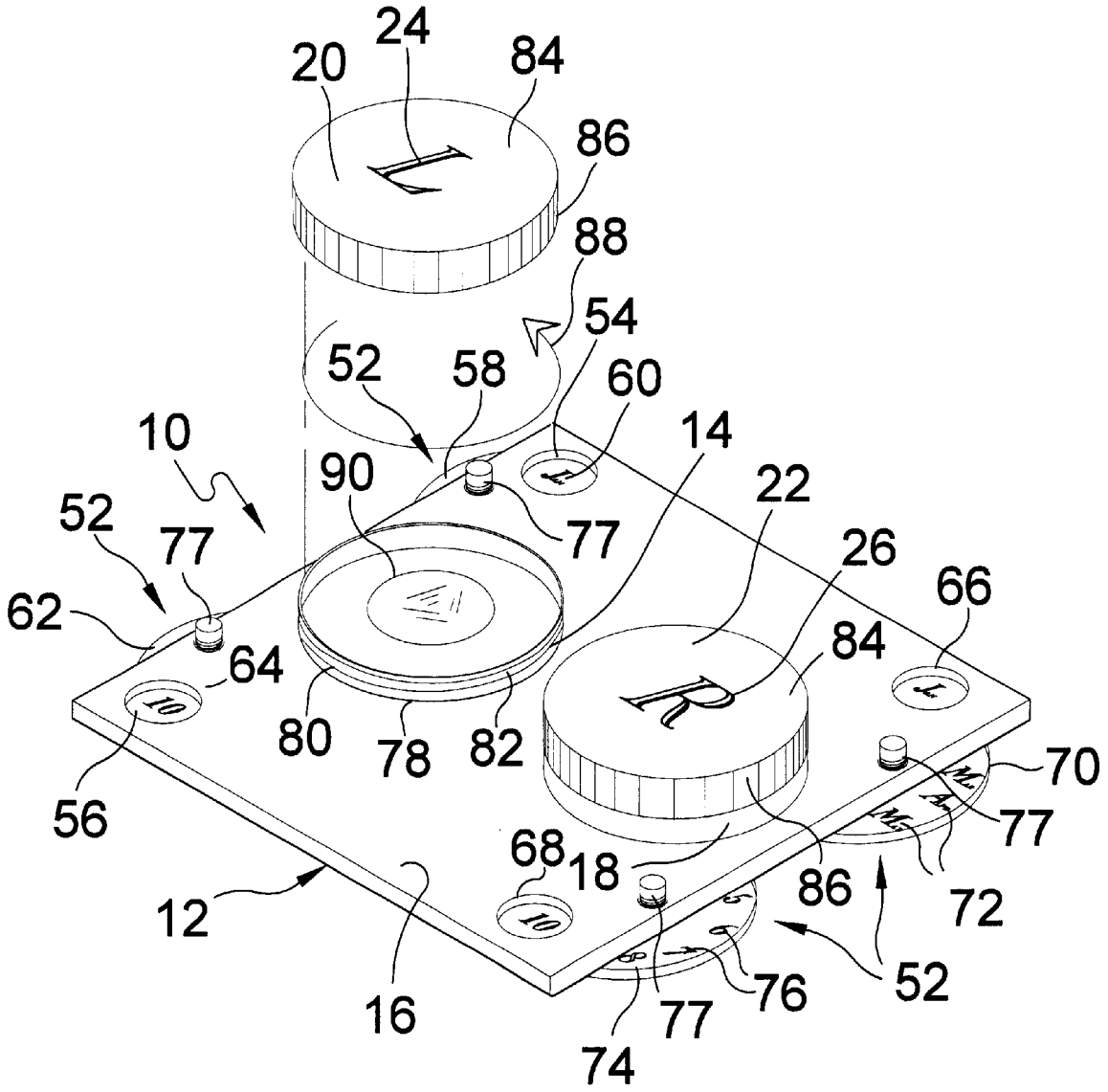
FIG. 3 is a top perspective view of the contact lens case of the present invention as shown in FIG. 2 illustrating removal of a lens cap.
Figure 7:
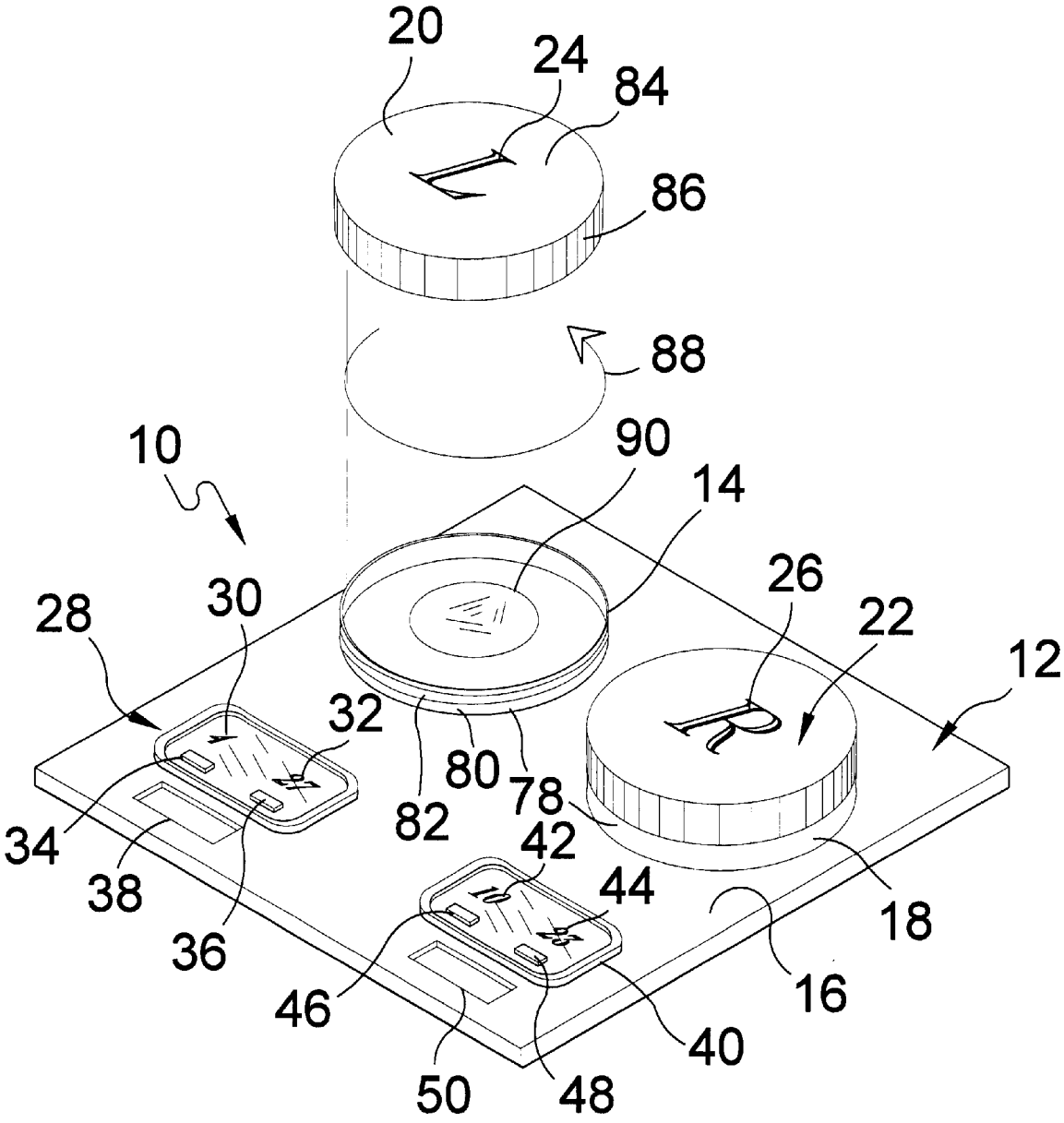
FIG. 7 is a top perspective view of the contact lens case of the present invention as shown in FIG. 1 illustrating removal of a lens cap.

A perspective view of the contact lens case 10 including the alternative timing mechanism 52 is shown in FIG. 3. A perspective view of the contact lens case 10 including the digital timing mechanisms 28 and 40 is illustrated in FIG. 7. These figures illustrate removal of the left side cover 20 from the left side cup 14. The interaction of the cup 14 and cover 20 are similar in both figures and thus individual description of each is not necessary. The left side cup 14 includes a side wall 78 extending from the top side 16 of the base 12. Spiraling around an outer side 80 of the side wall 78 is a thread 82. The left side cover 20 is formed from a base 84 and a skirt 86 depending therefrom. The base 84 has a circumference substantially equal to the circumference of the left side cup 14. Spiraling around an inner side of the skirt 86 is a thread (not shown) which mates with the thread 82 spiraling around the outer side 80 of the side wall 78. In order to remove the cover 20 from atop the left side cup 14, the cover 20 is turned in the direction indicated by the arrow labeled with the numeral 88 thereby disengaging the thread on the inner side of the skirt 86 from the thread 82 on the outer side 80 of the side wall 78. In order to re-secure the cover 20 atop the left side cup 14, the cover 20 is placed thereatop and turned in a direction opposite the direction of the arrow 88. The right side cup 18 and right side cover 22 are formed similarly to the left side cup 14 and left side cover 20. Furthermore, the right side cover 22 is removed from and secured atop the right side cup 18 in a manner similar to that described with reference to the left side cover 20 and left side cup 14.

This figure further illustrates the use of the cup 14 to retain a contact lens 90 therein. When the cup 14 is filled with a solution, a contact lens 90 may be placed therein and prevented from drying out. When the cover 20 is secured atop the cup 14, the contact lens 90 is retained within the cup 14 and may be safely carried with the user.

The timing mechanism 52 of FIG. 3 is provided for indicating the first date of use for the contact lens 90. Upon initial using of the contact lens 90, the user will adjust the timing mechanism 52 to indicate the month and date of first use. This is done by releasing the locking mechanism 77 on each wheel and rotating each wheel until the relevant month and date is viewable through the recesses.

The timing mechanisms 28 and 40 of FIG. 7 are provided for indicating the first date of use for contact lens'90. Upon initial using of the contact lens'90, the user will activate the adjustment button 38 or 50 to thereby place the month and date LED's in an editable mode. The user will then activate the month and date activation buttons until the month and date LED's indicate the desired date indicative of the month and date of first use. At this time the adjustment button 38 or 50 will be returning the month and date activation buttons to an uneditable mode.

Figure 4:
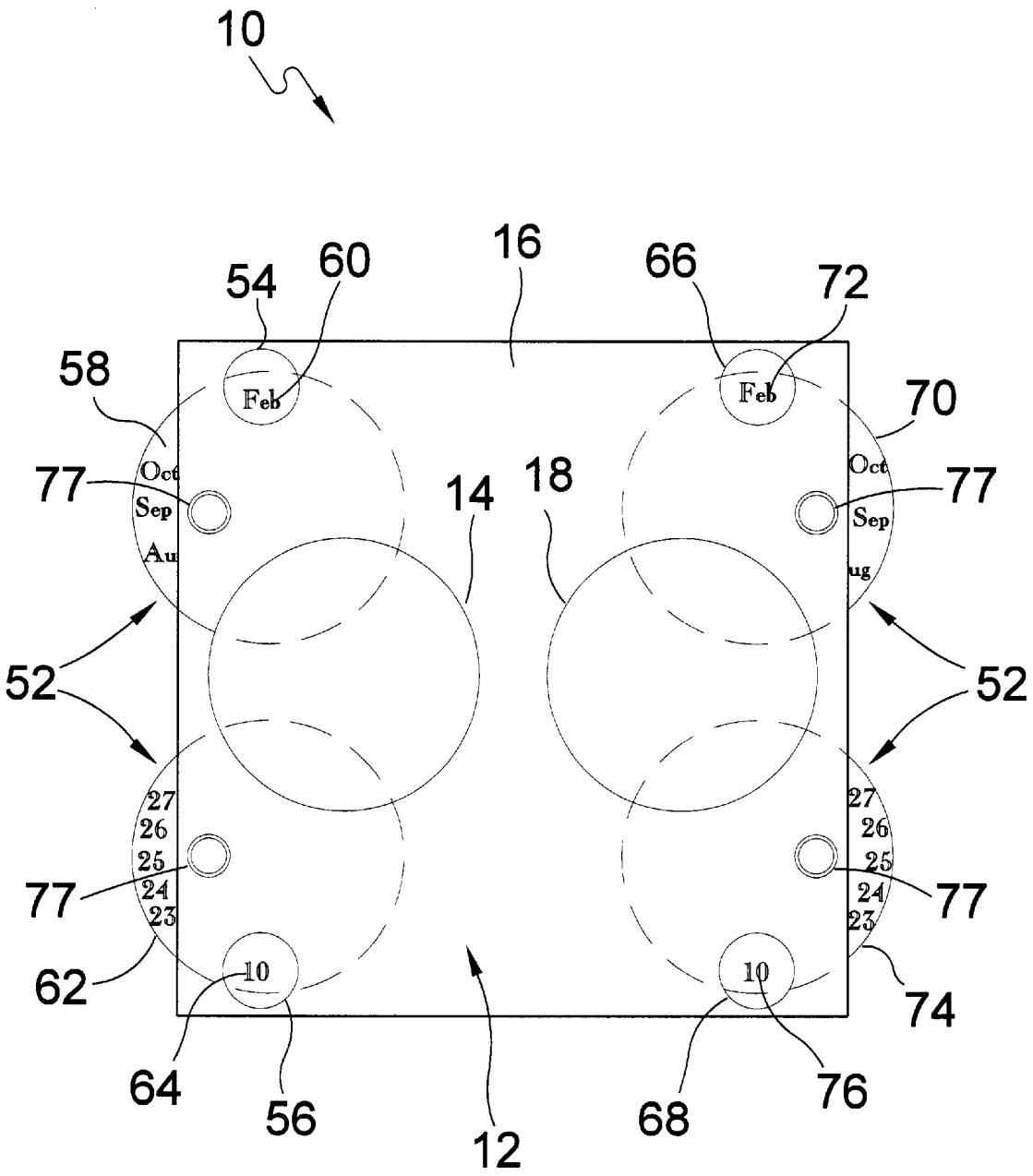
FIG. 4 is a top view of the contact lens case of the present invention illustrating the manual display wheels on the bottom side in dashed lines.

A top view of the contact lens case 10 including the timing mechanism 52 is shown in FIG. 4. The left side month wheel 52, left side date wheel 56, right side month wheel 70 and right side date wheel 74 are shown in partial dashed lines to indicate that they are positioned on the bottom side of the base 12. Positioned on the top side 16 are the left side cup 14 and right side cup 18. Extending through the base 12 are the left month recess 54, the right month recess 66, the left date recess 56 and the right date recess 68. The indicia 60 on the left month wheel 58 is positioned to allow one month to be viewable through the left month recess 54 at any one time. The indicia 72 on the right month wheel 70 is positioned to allow one month to be viewable through the right month recess 66 at any one time. The indicia 64 on the left date wheel 62 is positioned to allow one date to be viewable through the left date recess 56 at any one time. The indicia 76 on the right date wheel 74 is positioned to allow one date to be viewable through the right date recess 68 at any one time. The locking mechanism 77 is provided for each wheel to prevent unintentional rotation of the wheels and thus display of incorrect dates of first use.

Figure 5:
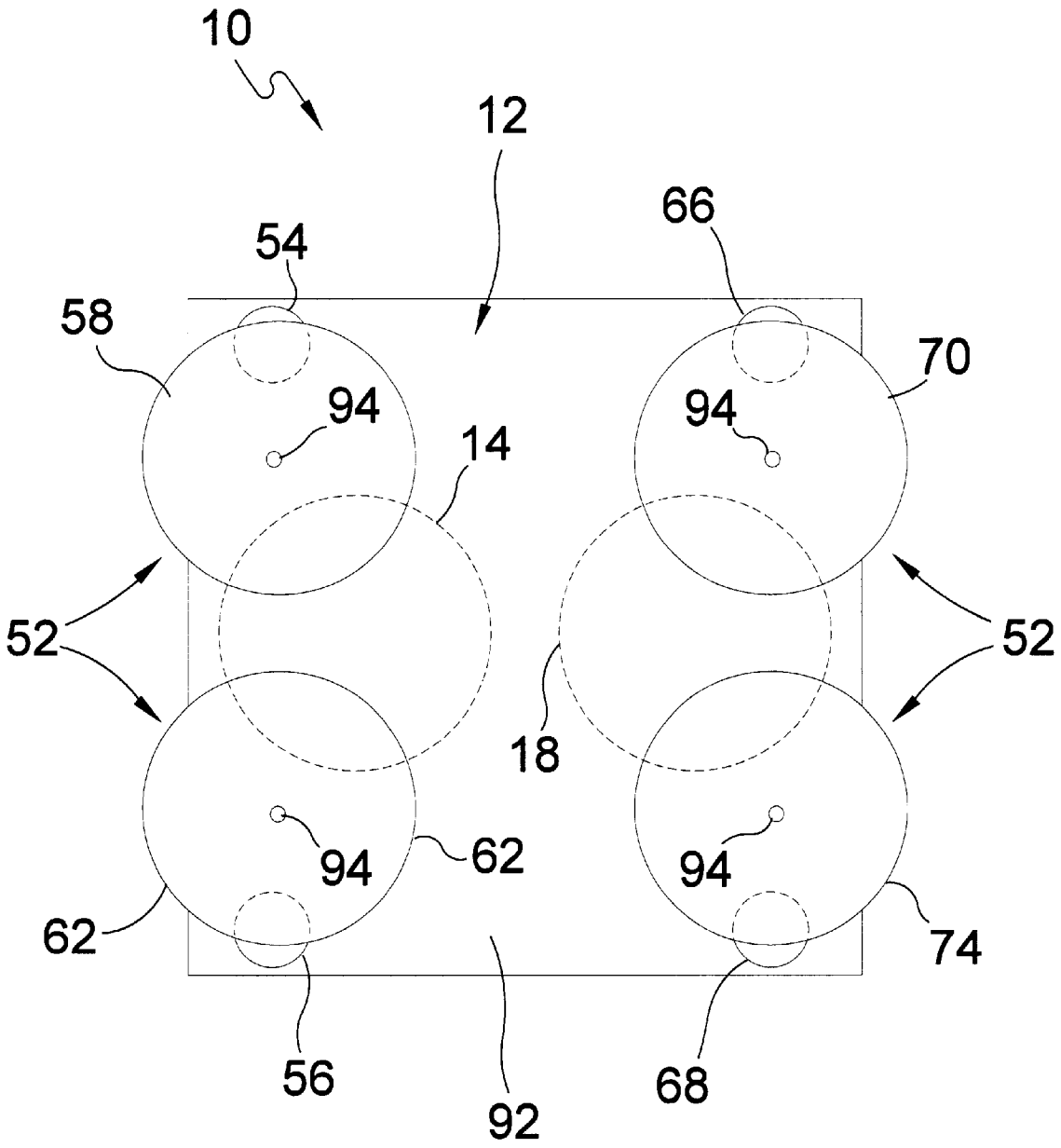
FIG. 5 is a bottom view of the contact lens case of the present invention illustrating the lens caps on the top side in dashed lines.
Figure 6:
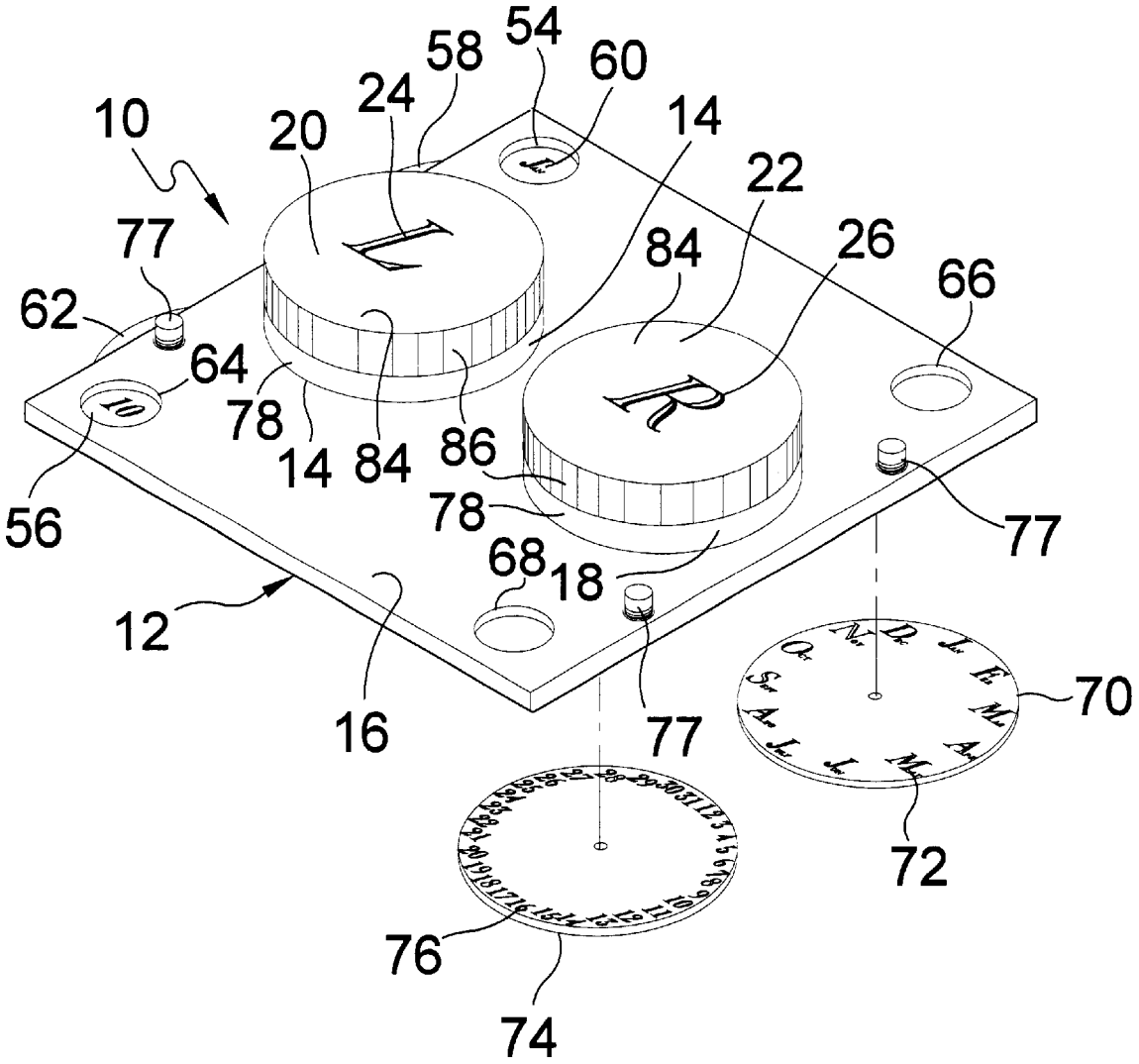
FIG. 6 is an exploded top perspective view of the contact lens case of the present invention.

A bottom view of the contact lens case 10 including the timing mechanism 52 is shown in FIG. 5. In this view, the left month wheel 58, the left date wheel 62, the right month wheel 70 and right date wheel 74 are seen. The left side cup 14 and right side cup 18 are shown in dashed lines as these components are provided on the top side 16 of the base. The left month recess 54, the left date recess 56, the right month recess 66 and right date recess 68 are shown in partial dashed lines as a portion of the recesses are covered by the left month wheel 58, the left date wheel 62, the right month wheel 70 and right date wheel 74, respectively and not visible from the bottom side 92. Each of the left month wheel 58, the left date wheel 62, the right month wheel 70 and right date wheel 74 are rotatably secured to the bottom side 92 of the base 12 by a pin 94. The exploded view of FIG. 6 illustrates the connection of the right month wheel 70 and right date wheel 74 to the bottom side 92. Each of the left month wheel 58, the left date wheel 62, the right month wheel 70 and right date wheel 74 include a pin hole 96 extending through a center thereof for receiving the pin 94 therethrough.

Figure 8:
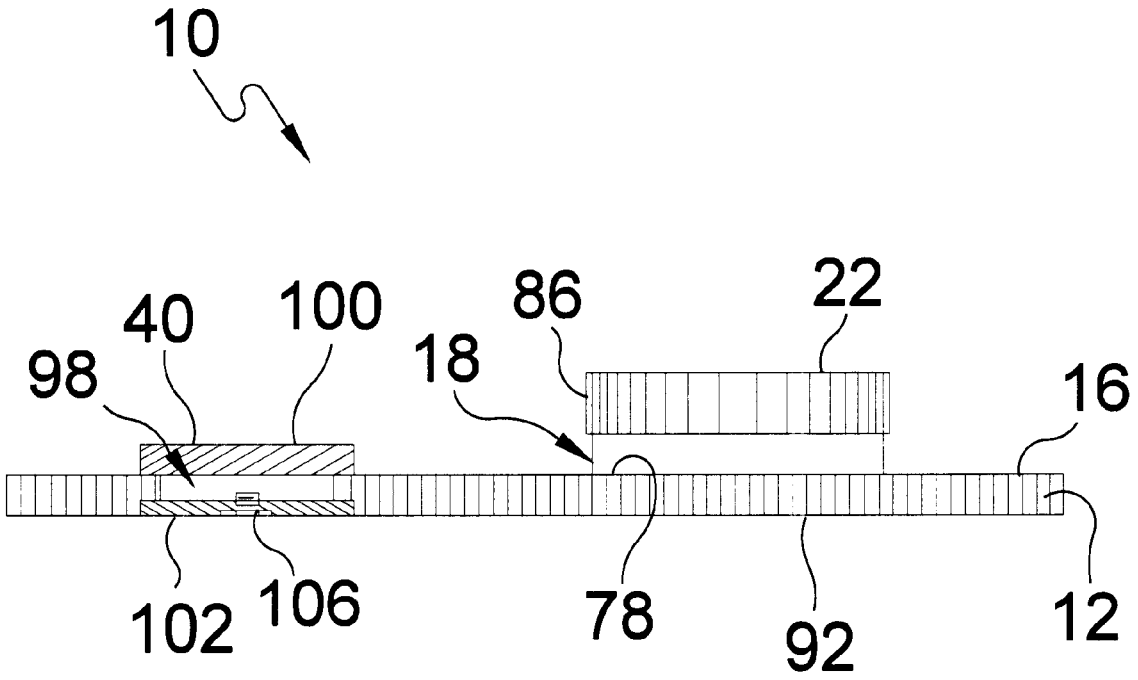
FIG. 8 is a side cross-sectional view of the contact lens case of the present invention as shown in FIG. 1.
Figure 9:
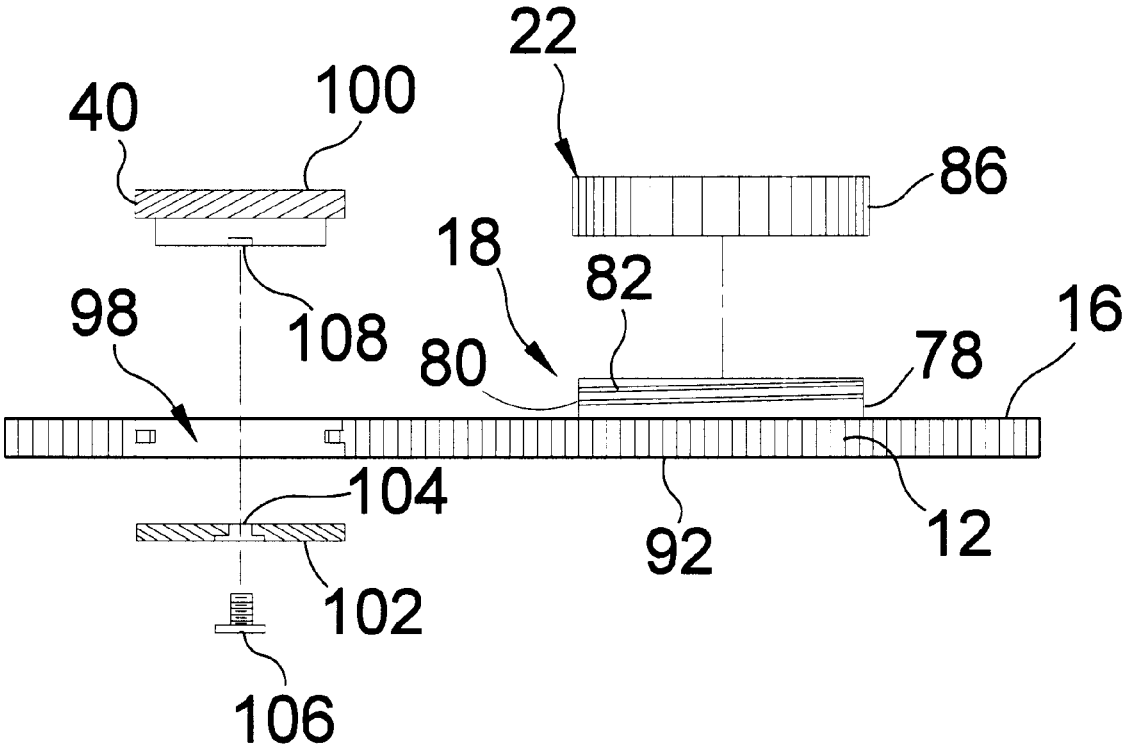
FIG. 9 is an exploded cross-sectional side view of the contact lens case of the present invention as shown in FIG. 1.

A right side cross-sectional view of the contact lens case 10 including the timing mechanisms 28 and 40 is shown in FIG. 8. An exploded view of the contact lens case 10 including the timing mechanisms 28 and 40 of FIG. 8 is shown in FIG. 9. As can be seen from these figures, a recess 98 extends through the base 12 for receiving the timing mechanism 40, a similar recess extends through the base 12 for receiving the timing mechanism 28. Both the left and right timing mechanisms are similar and thus discussion of only one of the timing mechanisms is necessary. The timing mechanism 40 includes a housing 100 containing the operational components of the timing mechanism 40 such as the month and date LED's, the month and date control buttons and the activation button. The housing 100 is of similar dimensions to the recess 98 and thus able to snugly fit into the recess 98. A plate 102 is positioned on a side of the recess 98 adjacent the bottom side 92 of the base 12. The plate 102 includes a recess 104 for receiving a screw 106 therethrough. The screw 106 is able to pass through the recess 104 and mate with a threaded recess 108 in the housing 100. The screw 106 thus secures the plate 102 to the housing 100 and maintains both within the recess 98.

Figure 10:
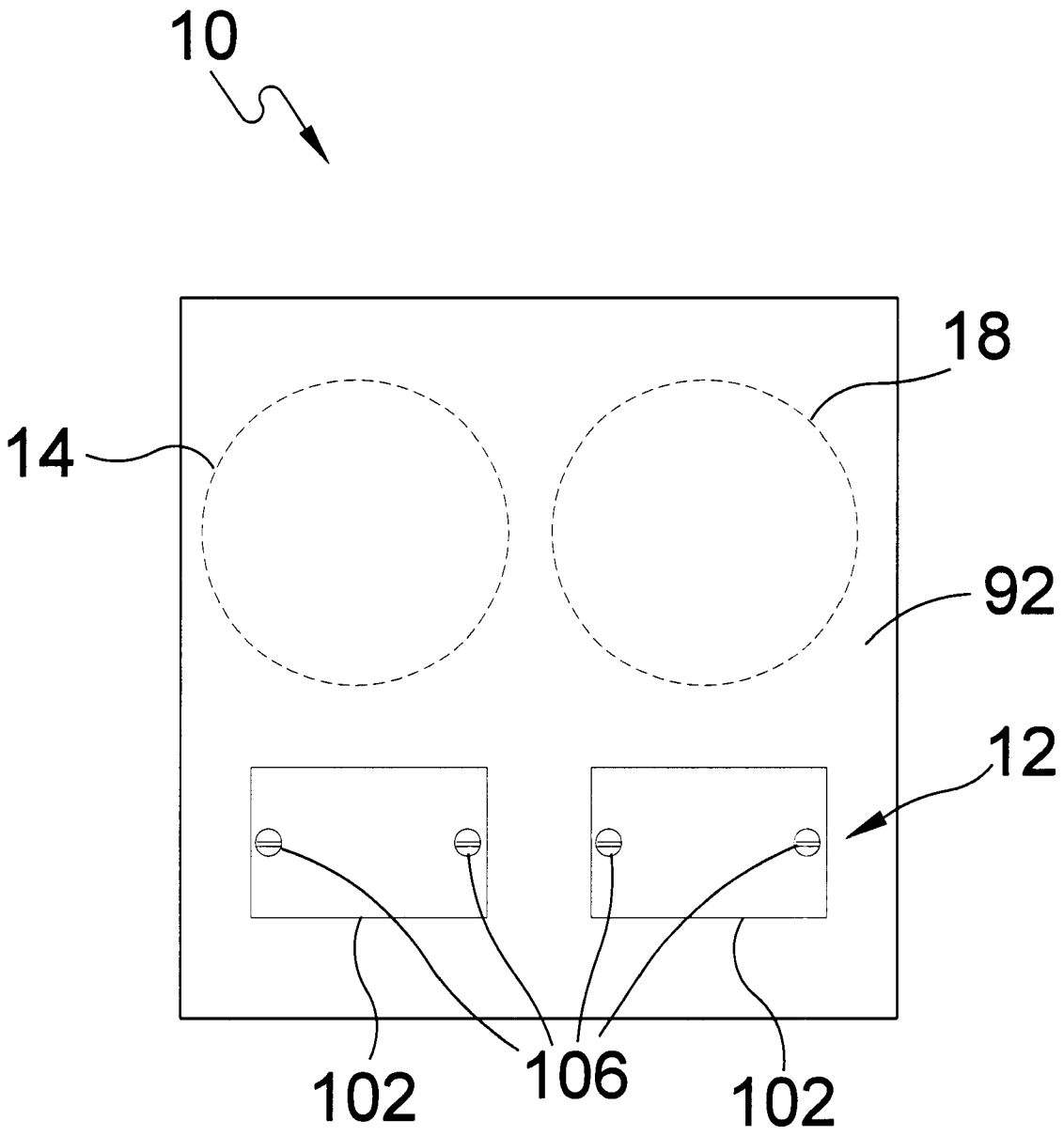
FIG. 10 is a bottom view of the contact lens case of the present invention as shown in FIG. 1.

A bottom side view of the contact lens case 10 including the timing mechanisms 28 and 40 is shown in FIG. 10. As can be seen from this view, that each plate may include a pair of recesses 104, each recess 104 receiving a screw 106. In this instance, each timing mechanism 28 and 40 will also include two recesses 108 for receiving each screw 106.

The operation of the contact lens case 10 will now be described with reference to the figures. In operation, the contact lens case 10 is used as would any conventional contact lens case for retaining contact lenses in a usable condition and for performing periodic cleaning of the lenses. When a person uses contact lenses, frequently first use of the lens used for each eye are not at the same time. This may be due to loss of one lens, different life expectancies for each lens, changing prescriptions of one eye, and numerous other instances. Due to such factors and the need for tracking when lenses are to be cleaned and the useful life of lenses it is necessary to know the date of first use of each lens. This allows for replacement of individual lenses when necessary while not discarding a still useful lens.

When a user replaces a contact lens, the proper timing mechanism of the contact lens case 10 of the present invention must be updated to read the date at which the lens was first used. Each contact lens case 10 is provided with left and right side cups, each for retaining a respective contact lens. A left side timing mechanism is provided to track the date of first use of the left side cup and a right side timing mechanism is provided to track the date of first use of the right side cup. If the contact lens case 10 including the digital timing mechanism is used, the date is changed as described below.

Upon initial use of a contact lens 90, the user activates the adjustment button 38 or 50 for the correct timing mechanism. If the user is replacing the contact lens for a left eye, the left side adjustment button 38 is pressed, if the user is replacing the contact lens for the right eye, the right side adjustment button 50 is pressed. Pressing of the adjustment button 38 or 50 places the month and date LED's of the respective timing mechanism in an editable mode. The user then presses the month correct button until the month LED indicates the month of first use. The user then activates the date correct button until the date LED indicates the correct date or first use. At this time the adjustment button is pressed returning the month and date activation buttons to an uneditable mode and preventing further unintended activation of the timing mechanism. The user then monitors the date to determine when it is time to replace the contact lens. Upon replacing the contact lens, the user will repeat the above procedure for editing the month and date of first use.

When the alternative mechanism is used, the user unlocks the locking mechanism 77 for the month and date wheels of the lens being replaced. If the user is replacing the contact lens for a left eye, the locking mechanism 77 for the left side month and date wheels are unlocked, if the user is replacing the contact lens for the right eye, the locking mechanism 77 for the right side month and date wheels are unlocked. The user is now able to adjust the date indicated by the desired timing mechanism. In order to change the month, the user rotates the month wheel until the correct month of first use is viewable through the month recess in the base. To change the date, the user rotates the date wheel until the correct date of first use is viewable through the date recess in the base. The user now relocks the locking mechanism to prevent further rotation of the month and date wheels. The user then monitors the date to determine when it is time to replace the contact lens. Upon replacing the contact lens, the user will repeat the above procedure for editing the month and date of first use.

From the above description it can be seen that the contact lens case of the present invention is able to overcome the shortcomings of prior art devices by providing a contact lens case which is able to store contact lenses and provide an indication of the length of time each individual lens has been used by a person for determining when each lens needs to be replaced. The contact lens case including a manual clock for indicating a month and day at which the person began use of an individual contact lens, the manual clock being either a digital LED readout or including a plurality of wheels including indicia and the case includes a recess extending therethrough whereby when each wheel is turned by a user, a particular month or day indicated by the indicia on the wheel is viewable through a respective recess. Furthermore, the contact lens case of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A contact lens case for tracking as time of use for both a left and right contact lens, said case comprising:

a) a base having a top side;

b) a left side cup positioned on the top side of said base for receiving the left contact lens;

c) a right side cup positioned on the top side of said base and spaced from said left side cup for receiving the right contact lens;

d) a left side timing mechanism for indicating a date related to use of the left contact lens, said left side timing mechanism being manually adjustable; and e) a right side timing mechanism for indicating a date related to use of the right contact lens, said right side timing mechanism being manually adjustable and independent of the left side timing mechanism;

f) said left side timing mechanism being positioned adjacent said left side cup on said base and said right side timing mechanism being positioned adjacent said right side cup on said base; and g) wherein said base includes a left side month recess, a left side date recess, a right side month recess and a right side date recess extending therethrough, said left side timing mechanism includes a month wheel having indicia indicative of the months of the year on a first side thereof and a date wheel having indicia indicative of dates on a first side thereof, and said right side timing mechanism includes a month wheel having indicia indicative of the months of the year on a first side thereof and a date wheel having indicia indicative of dates on a first side thereof, wherein said left side month wheel is rotatably connected to a bottom side of said base wherein said indicia indicative of a single month is viewable through said left side month recess, said left side date wheel is rotatably connected to a bottom side of said base wherein said indicia indicative of a single date is viewable through said left side date recess, said right side month wheel is rotatably connected to a bottom side of said base wherein said indicia indicative of a single month is viewable through said right side month recess and said right side date wheel is rotatably connected to a bottom side of said base wherein said indicia indicative of a single date is viewable through said right side date recess.

2. The contact lens case as recited in claim 1, wherein said left side timing mechanism includes a locking mechanism movable between a locked and unlocked position, wherein said locking mechanism prevents said left side month and date wheels from rotating when in said locked position and permits rotation of said left side month and date wheels when in said unlocked position.

3. The contact lens case as recited in claim 2, wherein said right side timing mechanism includes a locking mechanism movable between a locked and unlocked position, wherein said locking mechanism prevents said right side month and date wheels from rotating when in said locked position and permits rotation of said right side month and date wheels when in said unlocked.

4. The contact lens case as recited in claim 2, wherein said left side timing mechanism further includes a left side month pin for rotatably securing said left side month wheel to said bottom side of said base and a left side date pin for rotatably securing said left side date wheel to said bottom side of said base and said right side timing mechanism further includes a right side month pin for rotatably securing said right side month wheel to said bottom side of said base and a right side date pin for rotatably securing said right side date wheel to said bottom side of said base.

5. The contact lens case as recited in claim 1, wherein said right side timing mechanism includes locking mechanism movable between a locked and unlocked position, wherein said locking mechanism prevents said right side month and date wheels from rotating when in said locked position and permits rotation of said right side month and date wheels when in said unlocked position.

6. The contact lens case as recited in claim 1, wherein said left side cup and said right side cup each include a side wall extending from said base to form a pool and a cover for selectively restricting access to said pool formed by said side wall.

7. The contact lens case as recited in claim 6, wherein said side wall of both said left and right side cups each include an outer side having a thread spiraling therearound and said cover of both said left and right side cups each include a top side, a skirt having an inner wall extending from said top side and a thread spiraling around said inner wall of said skirt for mating with said thread on said respective side wall.

8. The contact lens case as recited in claim 6, wherein said cover of said left side cup includes indicia on the top side thereof indicating said left side cup is for receiving the left contact lens and said cover of said right side cup includes indicia on the top side thereof indicating said right side cup is for receiving the right contact lens.

* * * * *